US007926502B1

(12) United States Patent
Lott

(10) Patent No.: US 7,926,502 B1
(45) Date of Patent: Apr. 19, 2011

(54) JET RING ASSEMBLY AND METHOD FOR CLEANING EDUCTORS

(75) Inventor: William Gerald Lott, Houston, TX (US)

(73) Assignee: Vortex Systems (International) CI, Grand Cayman (KY)

( * ) Notice: Subject to any disclaimer, the term of this patent is extended or adjusted under 35 U.S.C. 154(b) by 0 days.

(21) Appl. No.: 12/816,969

(22) Filed: Jun. 16, 2010

Related U.S. Application Data

(60) Provisional application No. 61/218,183, filed on Jun. 18, 2009.

(51) Int. Cl.
*B01F 3/12* (2006.01)
*B01F 3/20* (2006.01)

(52) U.S. Cl. ..... 137/15.04; 137/240; 137/888; 366/163.2; 366/177.1; 366/182.3

(58) Field of Classification Search ..... 137/15.04, 137/15.05, 888, 240; 366/163.1, 163.2, 177.1, 366/182.3
See application file for complete search history.

(56) References Cited

U.S. PATENT DOCUMENTS 4,527,716 A 7/1985 Haas et al.
5,020,858 A 6/1991 Nishikawa
5,382,411 A 1/1995 Allen
5,447,394 A 9/1995 Shepard
5,507,237 A 4/1996 Barrow et al.
5,642,939 A 7/1997 Comardo
5,664,733 A 9/1997 Lott
5,722,552 A 3/1998 Olson
6,024,874 A 2/2000 Lott
6,223,903 B1 5/2001 Mansouri
6,357,906 B1 3/2002 Baudoin et al.
6,796,704 B1 9/2004 Lott
7,048,432 B2 5/2006 Phillippi et al.
7,111,975 B2 * 9/2006 Fenton et al. ..... 366/163.2
7,401,973 B1 7/2008 Lott
7,784,999 B1 * 8/2010 Lott ..... 137/888
2005/0058020 A1 3/2005 Lott
2005/0111298 A1 5/2005 Lott

* cited by examiner

*Primary Examiner* — Kevin L Lee
(74) *Attorney, Agent, or Firm* — Buskop Law Group, PC; Wendy Buskop

(57) ABSTRACT

An eductor with a jet ring assembly for generating a low pressure region for detaching and removing residual drilling fluid solids from the internal walls of the eductor is disclosed. The eductor can include: induction ports, liquid induction ports, a mixing chamber, a diffuser, and a jet ring adaptor that can generate the low pressure region. Also disclosed is a method for removing residual drilling fluid solids (wall cake) from internal walls of the eductor. The method can include: stopping the flow of a first pressurized fluid to the eductor, stopping discharge from a diffuser of the eductor, and pressurizing a jet ring assembly using a second pressurized fluid to detach and remove the wall cake from the internal walls of the eductor.

14 Claims, 7 Drawing Sheets

JET RING ASSEMBLY AND METHOD FOR CLEANING EDUCTORS

CROSS REFERENCE TO RELATED APPLICATIONS

The present application claims priority to and the benefit of U.S. Provisional Patent Application Ser. No. 61/218,183, which was filed on Jun. 18, 2009 and is entitled "JET RING ASSEMBLY AND METHOD FOR CLEANING EDUCTORS". This reference is incorporated herein its entirety.

FIELD

The present embodiments generally relate to an eductor with a jet ring assembly and a method for purging wall cake from a mixing device for drilling fluids.

BACKGROUND

A need exists for a sturdy, long lasting device that can mix drilling fluids and can simultaneously remove wall cake from within an eductor using a low-pressure region and a high-velocity stream.

The present embodiments meet these needs.

DETAILED DESCRIPTION OF THE EMBODIMENTS

Figure 1:
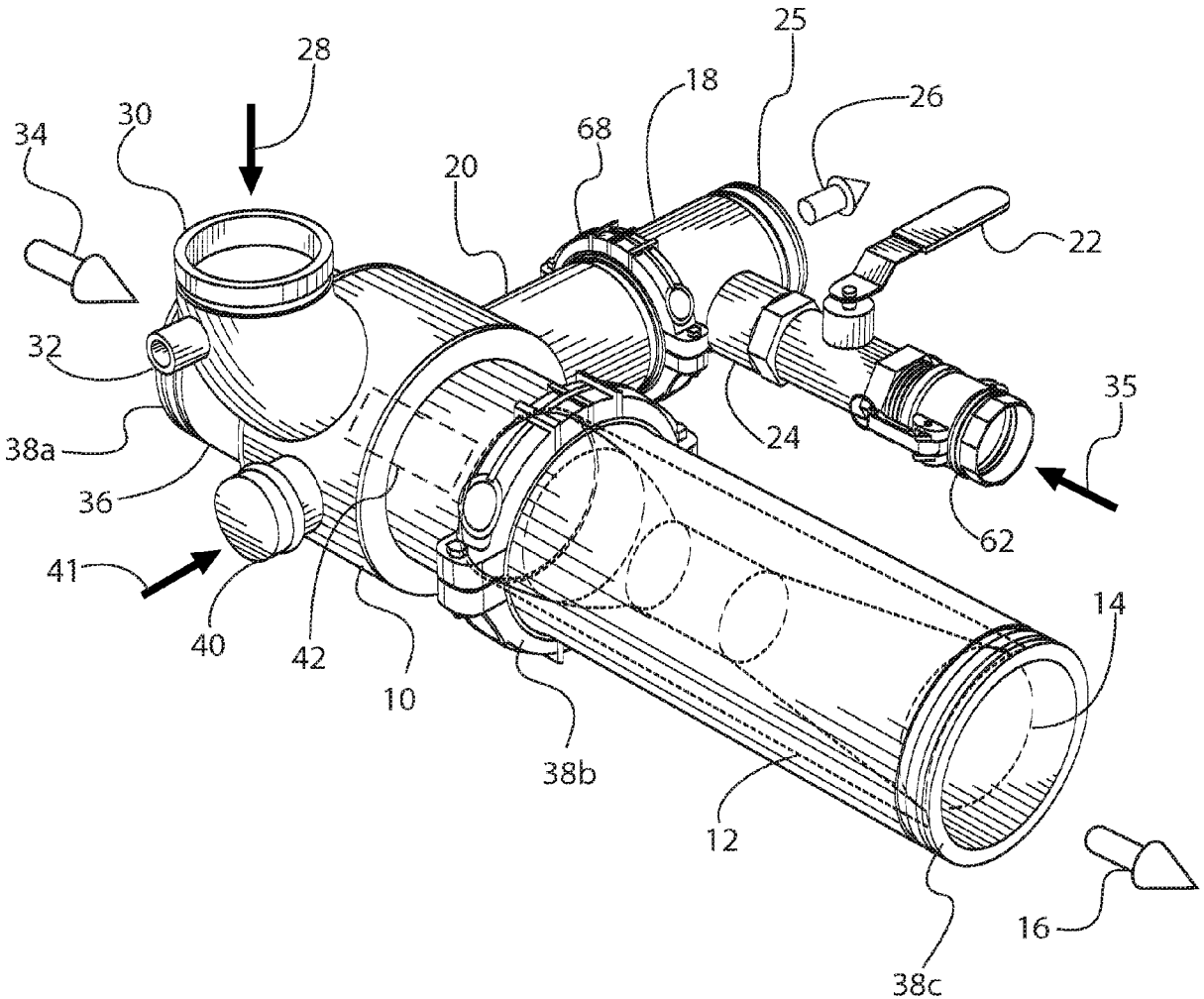
FIG. 1 is a perspective of an embodiment of the eductor with a jet ring adaptor and a diffuser section.

Before explaining the present assembly and method in detail, it is to be understood that the assembly and method are not limited to the particular embodiments and that the assembly and method can be practiced or carried out in various ways.

The present embodiments relate to an eductor with a jet ring assembly and a method for removing residual drilling fluid solids, which are also referred to herein as wall cake, from the internal walls of an eductor.

The term "eductor", as used herein, refers to the eductor as described in copending published US Patent Application No. 2005/0111298, which is incorporated herein by reference in its entirety as filed. The term "diffuser section", as used herein, refers to the diffuser as described in copending published US Patent Application No. 2005/0111298.

Applicant herein incorporates by reference the terms used in issued U.S. Pat. No. 7,401,973 to define the "eductor nozzle" or "lobestar nozzle", as the terms used herein refer to a non-circular asymmetrical lobe shaped orifice disposed within the eductor.

Many water-based drilling fluids can have a relatively high concentration of clay, such as Bentonite (clay-sodium silicate), to increase the slurry viscosity. The eductor used herein can be used for mixing particulate material, such as polymers, diatomaceous earth, talc, lime, paint pigments, powdered fire retardant materials, and other types of materials at a site.

One of the purposes of increased slurry viscosity is to better suspend drill cuttings and to flush the drill cuttings out of a drill bore during the course of a drilling operation.

Generally the Bentonite (clay-sodium silicate) and other chemical additives are fed through a feed hopper that can be installed over the eductor. As the Bentonite (clay-sodium silicate) and related powders are mixed through the eductor, a portion of the wetted clay can adhere to the walls of the eductor mixing chamber and to the downstream entrance to a Venturi section of a diffuser secured to the eductor, thereby building a wall cake that thickens and becomes a source of plugging and blockage during the continual mixing.

Pressurized fluid can enter the eductor and flow through the lobestar nozzle. The pressurized fluid can have an axial flow path and a radial flow path. As the eductor discharge traverses through the body, including the attached diffuser, a Venturi effect can be formed.

One or more embodiments can include an eductor, a jet ring adaptor, and a diffuser section.

The eductor can include: a mixing chamber for mixing liquid and dry components, at least a first induction port for flowing at least a first dry component into the mixing chamber, a liquid induction port for flowing a liquid into the mixing chamber, a jet ring induction port for expelling dislodged wall cake, and an insert nozzle with a lobestar orifice for receiving a first pressurized fluid and producing a high-velocity fluid stream.

The eductor can have internal walls. The internal walls of the eductor form the surrounding walls of the mixing chamber and the entrance into the Venturi section of the diffuser.

The eductor can be substantially hollow and can be made from a variety of metals, such as non-rusting stainless steel. The eductor can have a cross section from about one inch to about twelve inches. The eductor can be made from schedule 40 pipe or schedule 120 pipe, or another type of pipe.

The eductor can have pipe connections, including a first pipe connection, a second pipe connection, and a third pipe connection. The first pipe connection can connect the eductor to a pipe that can provide the first pressurized fluid. The second pipe connection can connect the mixing chamber to the diffuser section. The third pipe connection can connect the eductor to a downstream pipe for receiving the mixture after the mixing is completed. The pipe connections can be threaded, flanged, or collected together.

The jet ring adaptor can be removably connected to the jet ring induction port. The jet ring adaptor can include: a jet ring adaptor body, an annular nozzle, and a pressure inlet for receiving a second pressurized fluid and flowing the second pressurized fluid to the jet ring adaptor body.

The annular nozzle can be an insert type that can be easily inserted into the jet ring adaptor.

The diffuser section can be made of a conduit connected to the mixing chamber of the eductor with a diffuser insert in the conduit. The diffuser insert can include a parabolic inlet with inlet converging smooth contours, a throat communicating with the parabolic inlet, and a diffuser.

The diffuser can have extending sides. Fluid, dry components and liquid can mix in a low-pressure region of the mixing chamber, for detaching and removing wall cake from the internal walls of the eductor.

In operation, the first pressurized fluid can flow into the mixing chamber in the eductor.

The lobestar nozzle can pressurize the first pressurized fluid, creating a high-velocity stream, thereby generating a low-pressure region in the mixing chamber. The generated low-pressure region can allow liquid and dry components to be inducted into the mixing chamber from induction ports, including the at least first dry component through the at least first induction port and the liquid through the liquid induction port. The first dry component can be Bentonite and chemical additives.

The liquid can flow through the liquid induction port at a rate from about thirty gallons per minute to about one hundred fifty gallons per minute.

The first pressurized fluid can be a drilling fluid or cement slurry. The first pressurized fluid can flow into the insert nozzle at a rate that can vary depending on the size of the cross section of the eductor.

The first pressurized fluid can flow out of the lobestar orifice and into the mixing chamber with both axial and radial velocities. The vortices of flow produced from the first pressurized fluid, the liquid, and the at least first dry component can overlap each other, thereby producing uniform mixing at low pressures.

After mixing, a slurry discharge can flow out of the mixing chamber and can then flow through and out of the diffuser section. The slurry discharge can have a pressure less than the pressure of the first pressurized fluid.

During operation, when large amounts of Bentonite are used, residuals, also termed "wall cake", can thicken and build up on the internal parts of the eductor.

The jet ring adaptor can be activated when the jet ring adaptor receives a second pressurized fluid that can flow through the pressure inlet and into the jet ring adaptor body, generating a high-velocity fluid stream that can produce a low-pressure region within the jet ring adaptor.

The second pressurized fluid used to activate the jet ring adaptor can be drawn from the existing active drilling fluid system or a source of water. The second pressurized fluid can be a compressed gas, such as air. The second pressurized fluid can be compressible or non-compressible.

The annular nozzle can be constructed such that when the annular nozzle is inserted into the jet ring adaptor, a cavity can be formed so that the second pressurized fluid velocity can be is increased to produce a low-pressure region within the jet ring adaptor. The Bernoulli principle is utilized to form this low-pressure region.

The low-pressure region that is generated within the jet ring adaptor can be a lower pressure than the pressure near the internal walls of the eductor, thereby creating a suction that can cause the drilling fluid residual wall cake to collapse and dislodge from the internal walls of the eductor. The residual wall cake can then flow into the jet ring adaptor, can be expelled out through the jet ring outlet, and can be routed to the active drilling fluid system, to storage, or can be disposed of A fluid control valve, such as a ball valve, can be installed on the pressure inlet to regulate a flow rate of the second pressurized fluid in a range from about thirty psi to about one hundred fifty psi.

At least one vacuum gauge can be disposed on the at least first induction port, or on other induction ports of the eductor. One or more embodiments can include multiple induction ports.

One or more embodiments relate to a method for removing residual drilling fluid solids (wall cake) from the walls of an eductor. The method can include stopping a flow of the first pressurized fluid to the eductor. The method can further include stopping all discharge from a diffuser section secured to the eductor, and pressurizing a jet ring assembly secured to the eductor using a second pressurized fluid, thereby detaching and removing the wall cake from the internal walls of the eductor.

Referring now to the FIG. 1, an eductor 10 is depicted with a mixing chamber 42 and an insert nozzle 36 that can receive a first pressurized fluid 34.

The insert nozzle 36 can be disposed within a first pipe connection 38*a*. The first pipe connection 38*a* can be used to connect the eductor 10 to a pipe that can provide the first pressurized fluid 34.

A first induction port 30 can be in fluid communication with the eductor 10. The first induction port 30 can flow a first dry component 28 into the mixing chamber 42. A vacuum gauge port 32 can be disposed on the first induction port 30.

The eductor 10 can have a jet ring induction port 20 for engaging a jet ring adaptor body 18 using a jet ring adaptor pipe connection 68, which can be a threaded, flanged, or collated connection.

The jet ring adaptor body 18 can have a pressure inlet 24 for receiving a second pressurized fluid 35 through a fluid control valve 22. The assembly can have at least one fastener 62. The fastener 62 can be a quick connect fastener.

A jet ring outlet 25 can be disposed on the jet ring adaptor body 18, which can provide an exit for dislodged wall cake 26 from within the mixing chamber 42.

A liquid induction port 40 can be disposed opposite the jet ring induction port 20. A liquid 41, such as a caustic solution, can flow into the eductor 10 through liquid induction port 40.

A diffuser section 12 can be removably connected to the eductor 10 at a second pipe connection 38*b*. The diffuser section 12 can include a diffuser insert 14. The diffuser section 12 can flow a slurry discharge 16 from the mixing chamber 42. The diffuser section 12 can have a third pipe connection 38*c* for engaging a downstream pipe after mixing is completed.

Figure 2:
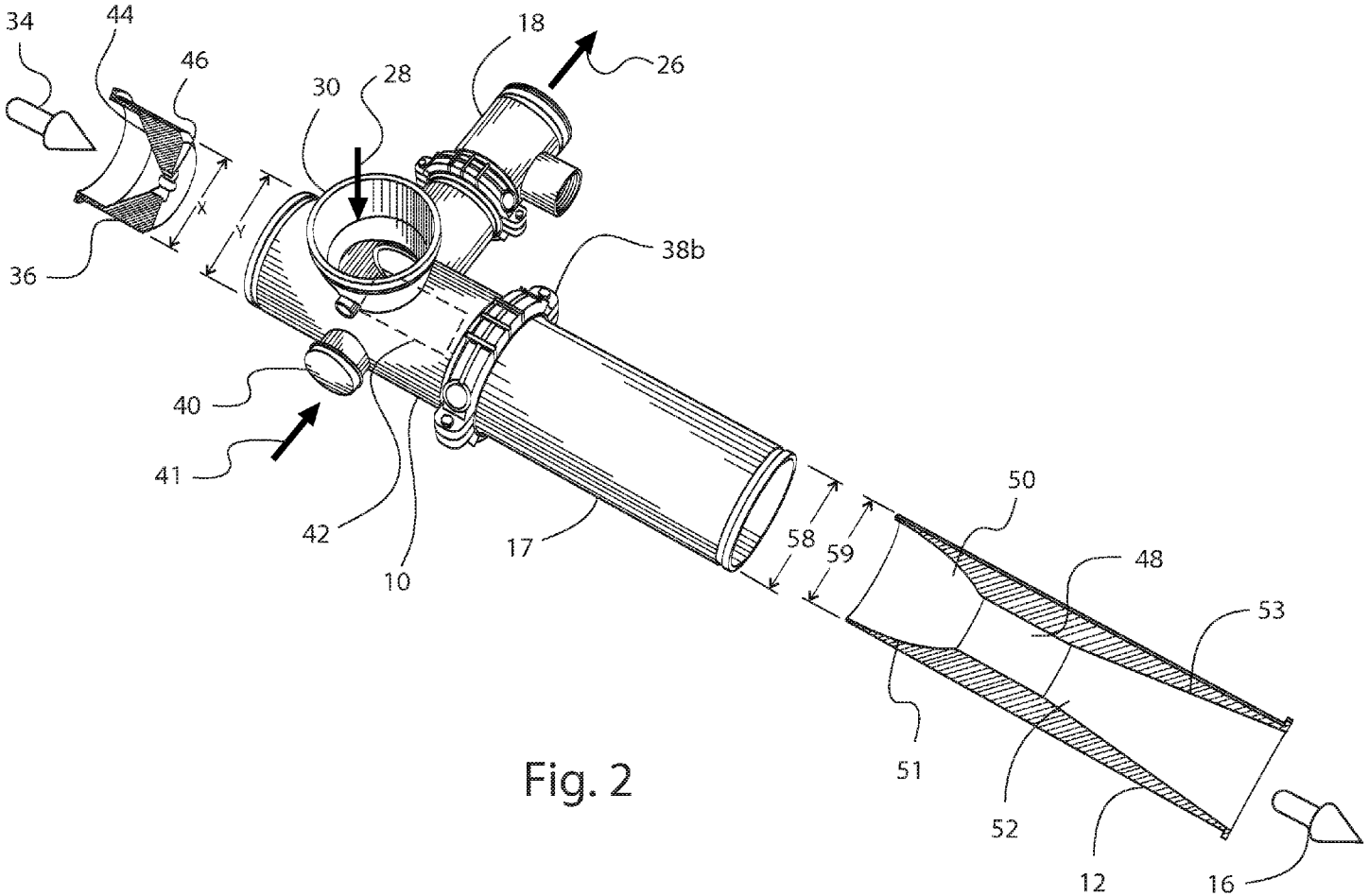
FIG. 2 is an exploded view of the assembly of FIG. 1.

Referring now to FIG. 2, an exploded isometric view of the eductor 10 is depicted.

The first pressurized fluid 34 can flow through the insert nozzle 36, which can have a lobestar orifice 46. The inert nozzle 36 can have insert converging smooth contours 44. The first pressurized fluid 34 can then flow into the mixing chamber 42 in the eductor 10.

The cross section 59 of the diffuser section 12 can be less than the internal conduit cross section 58 of the conduit 17, thereby allowing the diffuser section 12 to slidably engage the conduit 17.

The diffuser section 12 can have a parabolic inlet 50 with inlet converging smooth contours 51, throat 48, a diffuser 52, and extending sides 53. The slurry discharge 16 is depicted exiting the diffuser 52.

The pipe connection 38*b* is shown providing a removable connection between the conduit 17 and the mixing chamber 42.

Figure 3:
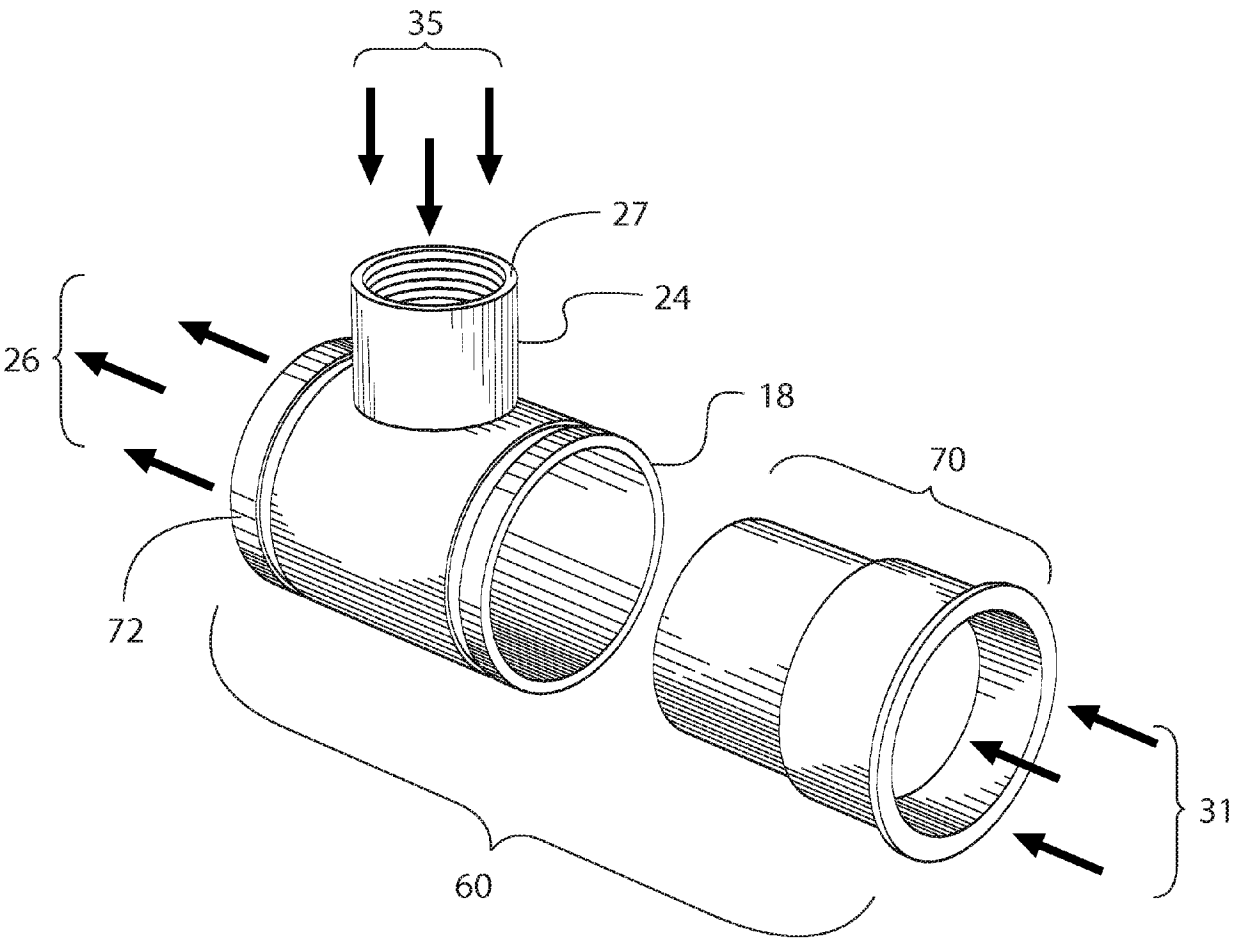
FIG. 3 is an exploded view of the jet ring adaptor.

FIG. 3 is an exploded view of the jet ring adaptor 60. As the second pressurized fluid 35 flows into the jet ring adaptor body 18, the wall cake flow 31 is drawn or sucked into the jet ring adaptor body from the eductor. The wall cake flow 31 can flow through the annular nozzle 70, which can be inserted into the jet ring adaptor body 18 with a slip fit.

The dislodged wall cake 26 can flow from the jet ring adaptor body 18 through a pipe connection 72. Threads 27 can enable engagement of a pipe with the pressure inlet 24. Other types of connection means can also be used.

Figure 4:
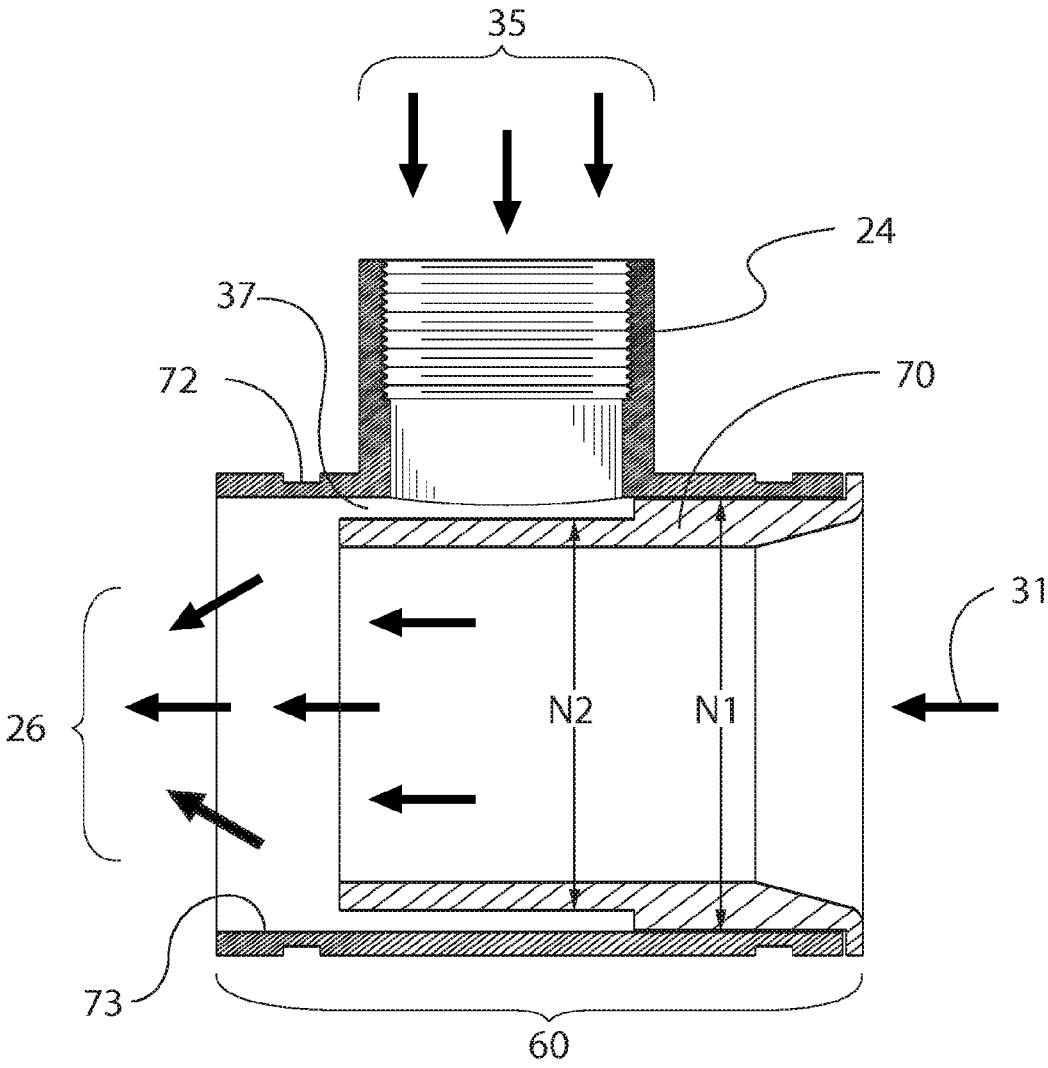
FIG. 4 is a cross sectional view of the jet ring adaptor of FIG. 3.

FIG. 4 shows a cross sectional view of the jet ring adaptor 60 usable to clean the eductor 10.

The wall cake flow 31 is depicted entering the jet ring adaptor 60. The dislodged wall cake 26 is shown exiting from the pipe connection 72. The second pressurized fluid 35 is shown entering the pressure inlet 24.

The annular nozzle 70 has first thickness "N1", which forms a tight fit against interior wall 73 of the jet ring adaptor body 18. The annular nozzle 70 further has a second thickness "N2" which is less than the first thickness "N1", thereby forming a cavity 37 between the annular nozzle 70 and the interior wall 73 of the jet ring adaptor body 18, for increasing the velocity of the second pressurized fluid 35 as it flows into the jet ring adaptor body 18.

Figure 5:
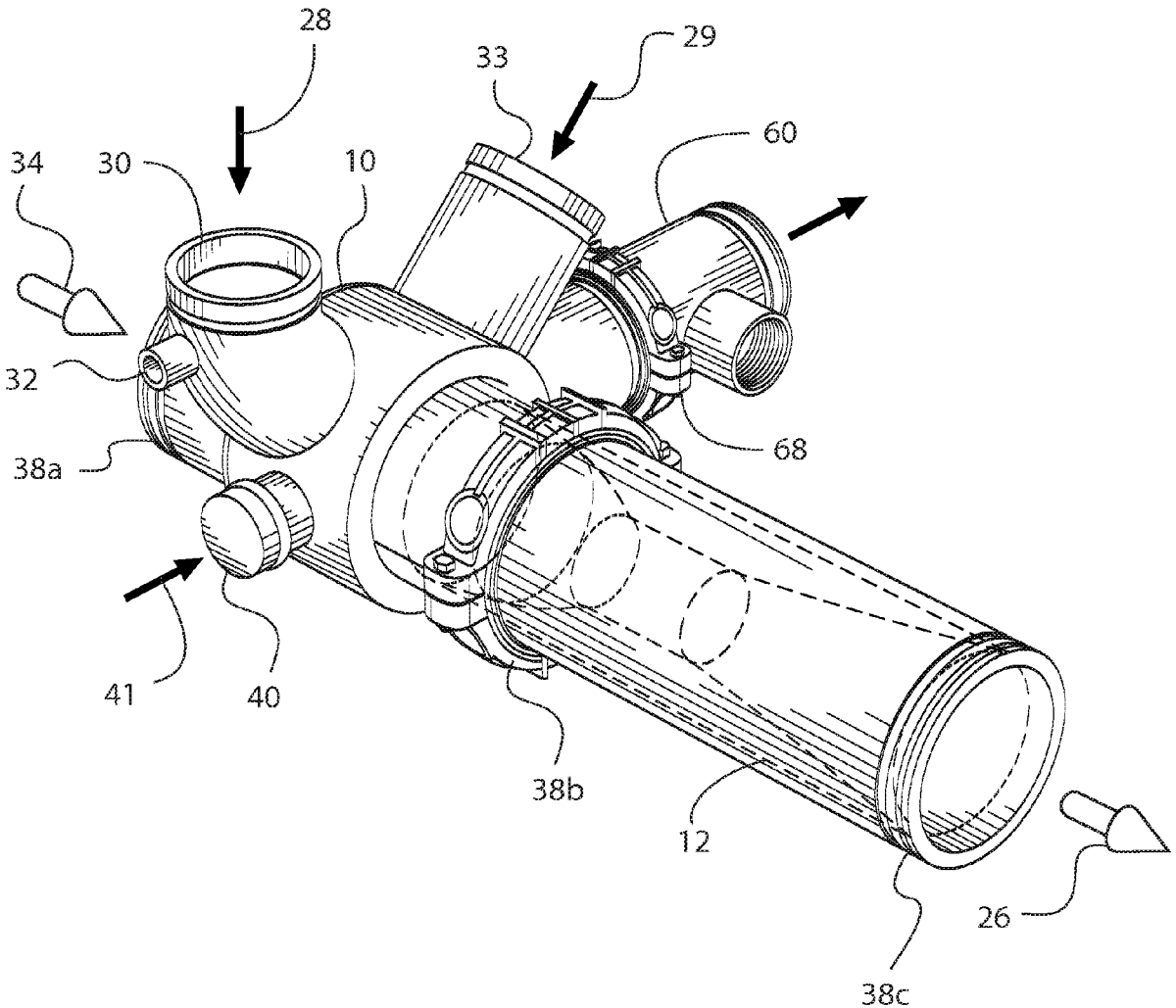
FIG. 5 is an embodiment of the eductor with the jet ring adaptor and the diffuser section, with a second induction port.

FIG. 5 depicts another embodiment of the eductor 10 with a jet ring assembly comprising at least a first induction port 30 and at least one supplementary induction port 33.

The first dry component 28 is depicted entering the eductor 10 through the first induction port 30, and a supplementary dry component 29 is depicted entering the eductor 10 through the supplementary induction port 33, and flowing into the mixing chamber 42. The supplementary dry component 29 can flow from a silo or surge tank.

Figure 6:
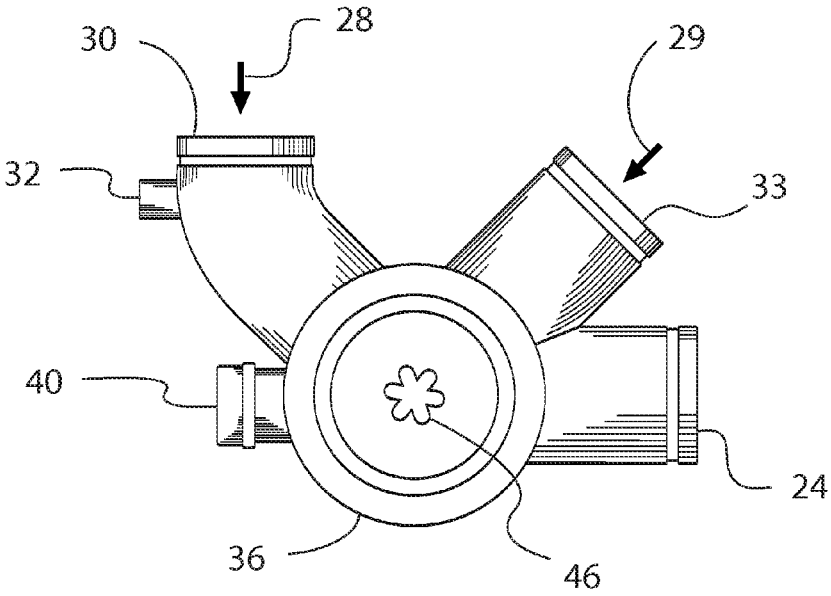
FIG. 6 is a front view of an embodiment with a second induction port.

FIG. 6 shows a front view of the embodiment depicted in FIG. 5 including the first induction port 30, the first dry component 28, the vacuum gauge port 32, the liquid induction port 40, the insert nozzle 36, the at least one supplementary induction port 33, the supplementary dry component 29, the pressure inlet 24, and the lobestar orifice 46.

Figure 7:
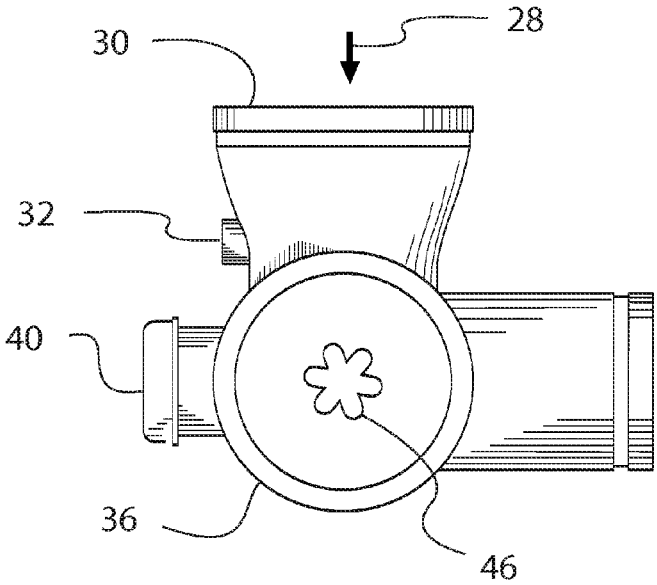
FIG. 7 is a front view of an embodiment.

FIG. 7 shows a front view of the embodiment depicted in FIG. 1, including the first induction port 30, the first dry component 28, the vacuum gauge 32, the liquid induction port 40, the insert nozzle 36, and the lobestar orifice 46.

Figure 8:
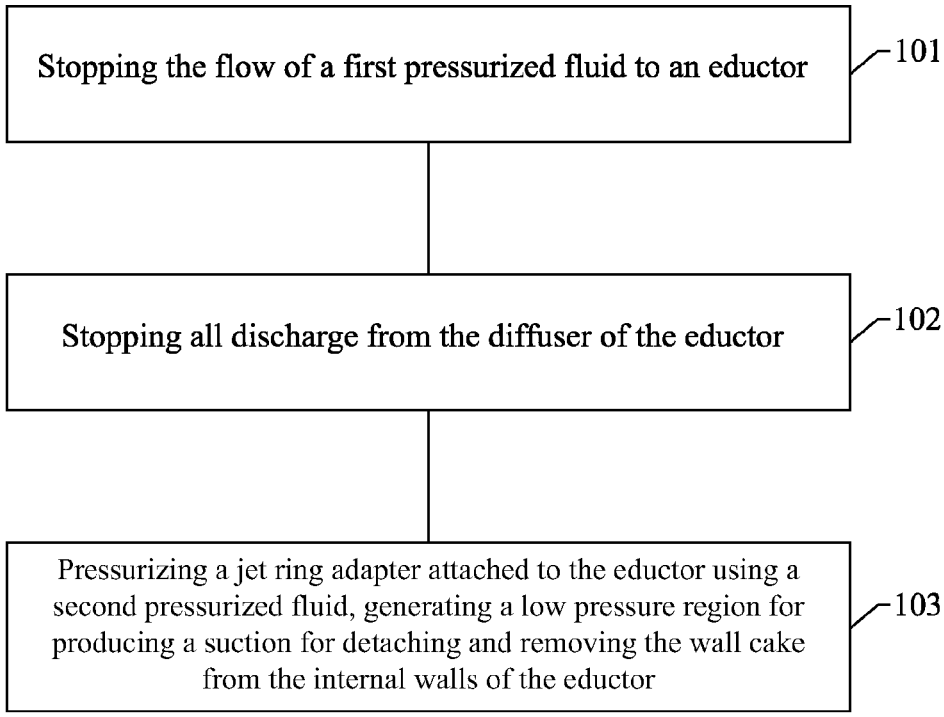
FIG. 8 is a flow chart of an embodiment of a method.

FIG. 8 depicts a flow chart for an embodiment of a method.

The method can include stopping the flow of a first pressurized fluid to an eductor, as illustrated by box 101.

The method can include stopping all discharge from the diffuser of the eductor, as illustrated by box 102.

The method can include pressurizing a jet ring adaptor attached to the eductor using a second pressurized fluid, generating a low pressure region for producing a suction for detaching and removing the wall cake from the internal walls of the eductor, as illustrated by box 103.

While these embodiments have been described with emphasis on the embodiments, it should be understood that within the scope of the appended claims, the embodiments might be practiced other than as specifically described herein.

What is claimed is:

1. An assembly for generating a low pressure region for detaching and removing residual drilling fluid solids from internal walls of an eductor, the assembly comprising:

a. an eductor with internal walls, the eductor comprising:

(i) a first induction port in fluid communication with a mixing chamber of the eductor for introducing a first dry component into the mixing chamber;

(ii) a jet ring induction port in fluid communication with the mixing chamber;

(iii) a liquid induction port in fluid communication with the mixing chamber for introducing a liquid into the mixing chamber; and (iv) an insert nozzle in fluid communication with the mixing chamber for receiving a first pressurized fluid, and for producing a first high velocity fluid stream for generating a first low pressure region within the mixing chamber, wherein the liquid and the first dry component mix within the mixing chamber in the first low pressure region;

b. a jet ring adaptor removably connected to the eductor at the jet ring induction port, wherein the jet ring adaptor comprises:

(i) a jet ring adaptor body;

(ii) a jet ring outlet for providing an exit for residual drilling fluid solids;

(iii) a pressure inlet for receiving a second pressurized fluid and flowing the second pressurized fluid to the jet ring adaptor body, thereby producing a second high velocity fluid stream for generating a second low pressure region within the eductor; and (iv) an annular nozzle disposed within the jet ring adaptor body forming a cavity within the jet ring adaptor body, thereby increasing a velocity of the second high velocity fluid stream, and decreasing a pressure of the second low pressure region within the eductor; and c. a diffuser section comprising a conduit removably connected to the mixing chamber and a diffuser insert disposed within the conduit, wherein the diffuser insert comprises:

(i) a parabolic inlet with inlet converging smooth contours;

(ii) a throat in fluid communication with the parabolic inlet; and (iii) a diffuser with extending sides, wherein the diffusing is in fluid communication with the throat, and wherein the second low pressure region within the eductor produces a suction that causes the residual drilling fluid solids to dislodge from the internal walls of the eductor, to flow into the jet ring adaptor, and to flow out of the jet ring outlet.

2. The assembly of claim 1, wherein the insert nozzle comprises insert converging smooth contours and a lobestar orifice.

3. The assembly of claim 1, further comprising:

a. a first pipe connection for connecting the eductor proximate the inlet nozzle to a pipe that provides the first pressurized fluid;

b. a second pipe connection for connecting the diffuser section to the mixing chamber; and c. a third pipe connection disposed on the diffuser section opposite the second pipe connection for engaging a downstream pipe.

4. The assembly of claim 1, further comprising at least one vacuum gauge port disposed on the first induction port.

5. The assembly of claim 1, further comprising at least one supplementary induction port, for flowing at least one supplementary dry component into the mixing chamber.

6. The assembly of claim 5, wherein the first dry component, the liquid, and the at least one supplementary dry component flow into the mixing chamber simultaneously.

7. The assembly of claim 1, wherein the jet ring adaptor further comprises a fluid control valve for regulating flow of the second pressurized fluid into the jet ring adaptor body.

8. The assembly of claim 1, wherein the diffuser insert is made of urethane.

9. A method for removing residual drilling fluid solids from internal walls of an eductor, the method comprising:

a. stopping flow of a first pressurized fluid to an eductor, wherein the eductor comprises a mixing chamber and a jet ring induction port in fluid communication with the mixing chamber;

b. stopping all discharge from a diffuser section secured to the eductor; and c. pressurizing a jet ring assembly using a second pressurized fluid to produce a first low pressure region within the eductor, wherein the jet ring assembly comprises a jet ring adaptor removably connected to the eductor at the jet ring induction port, and wherein the jet ring adaptor comprises:

(i) a jet ring adaptor body;

(ii) a jet ring outlet for providing an exit for residual drilling fluid solids from the jet ring adaptor;

(iii) a pressure inlet for receiving the second pressurized fluid and flowing the second pressurized fluid into the jet ring adaptor body, and producing a high velocity fluid stream to generate a the first low pressure region within the eductor; and (iv) an annular nozzle disposed within the jet ring adaptor body for forming a cavity within the jet ring adaptor body, thereby increasing a velocity of the second pressurized fluid, and decreasing a pressure of the first low pressure region within the eductor, wherein the first low pressure region within the eductor produces a suction that causes the residual drilling fluid solids to dislodge from internal walls of the eductor, to flow into the jet ring adaptor, and to flow out of the jet ring outlet.

10. The method of claim 9, further comprising, after stopping the flow of the first pressurized fluid to the eductor, stopping the flow of a first dry component through a first induction port disposed on the eductor, and stopping the flow of a liquid through a liquid induction port disposed on the eductor.

11. The method of claim 9, further comprising using at least one vacuum gauge port disposed on the first induction port for measuring a pressure within the first induction port.

12. The method claim 9, further comprising using a fluid control valve disposed in fluid communication with the pressure inlet to regulate flow of the second pressurized fluid into the jet ring adaptor body.

13. The method of claim 9, further comprising using at least one supplementary induction port disposed on the eductor for flowing at least one supplementary dry component into the mixing chamber.

14. The method of claim 13, further comprising, after stopping the flow of the first pressurized fluid to the eductor, stopping the flow of the at least one supplementary dry component through the at least one supplementary induction port.

* * * * *